US009676588B2

(12) United States Patent
Haska

(10) Patent No.: US 9,676,588 B2
(45) Date of Patent: Jun. 13, 2017

(54) PRESSER FINGER FOR A ROVING WINDER, ROVING WINDER, AND METHOD OF WINDING A ROVING

(75) Inventor: Petr Haska, Ceska Trebova (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 409 days.

(21) Appl. No.: 14/128,753

(22) PCT Filed: Jun. 22, 2012

(86) PCT No.: PCT/CH2012/000136

§ 371 (c)(1),
(2), (4) Date: Dec. 23, 2013

(87) PCT Pub. No.: WO2013/000097

PCT Pub. Date: Jan. 3, 2013

(65) Prior Publication Data

US 2014/0117142 A1 May 1, 2014

(30) Foreign Application Priority Data

Jun. 30, 2011 (CZ) ..... 2011-398

(51) Int. Cl.
*B65H 54/36* (2006.01)
*B65H 57/00* (2006.01)
*D01H 1/36* (2006.01)

(52) U.S. Cl.
CPC ..... *B65H 57/006* (2013.01); *B65H 54/36* (2013.01); *B65H 54/365* (2013.01); *D01H 1/36* (2013.01); *B65H 2701/31* (2013.01)

(58) Field of Classification Search
CPC ..... B65H 54/28; B65H 54/36; B65H 57/00; B65H 57/006; B65H 57/06; B65H 57/20;
(Continued)

(56) References Cited

U.S. PATENT DOCUMENTS 1,997,709 A * 4/1935 Williams ..... B65H 59/14 242/154
2,600,037 A 6/1952 West
(Continued)

FOREIGN PATENT DOCUMENTS

FR 907 113 3/1946

OTHER PUBLICATIONS

PCT Search Report, Sep. 25, 2012.

*Primary Examiner* — William E Dondero
*Assistant Examiner* — Nathaniel Adams
(74) *Attorney, Agent, or Firm* — Dority & Manning, P.A.

(57) ABSTRACT

The invention relates to a presser finger (4) which is a component of a winder for winding a roving on to a rotating bobbin (1) with a longitudinal axis (10). The presser finger (4) has a carrying arm (40) with a longitudinal axis (8) and a roving 4 guide element. The presser finger (4) also has a guide plate (5) for guiding the roving on to a rotating bobbin (1). The presser finger (4) is alternatingly movable in the direction (X) of the longitudinal axis (10) of the rotating bobbin (1), and this movement of the presser finger (4) is provided by a drive means. The invention also relates to a roving winder with the aforementioned presser finger (4) and a method of winding a roving with the aid of the aforementioned presser finger (4).

9 Claims, 3 Drawing Sheets

(58) Field of Classification Search
CPC ..... B65H 54/2803–54/365; B65H 2701/31; D01H 1/006; D01H 1/04; D01H 7/32; D01H 13/04
See application file for complete search history.

(56) References Cited

U.S. PATENT DOCUMENTS 4,109,877 A * 8/1978 Yates ..... B65H 54/74 242/486.7
2009/0289141 A1 11/2009 Griesshammer et al.

* cited by examiner

PRESSER FINGER FOR A ROVING WINDER, ROVING WINDER, AND METHOD OF WINDING A ROVING

TECHNICAL FIELD

The invention relates to a presser finger for a winder for winding a roving on to a rotating bobbin, in which the rotating bobbin has a longitudinal axis, the presser finger having a carrying arm with a longitudinal axis, a roving guide element and a guide plate.

The invention also relates to a roving winder with the aforementioned presser finger and a method of winding a roving with the aid of the aforementioned presser finger.

BACKGROUND

Fine textile yarns are usually produced on spinning frames, such as ring spinning frames. The technology for preparing fibre material for this production process includes the operation of slubbing, in which a relatively fine cohesive roving is formed from a staple fibre sliver, with a small twist. As it leaves the slubbing frame, the roving is wound on to a roving bobbin to form a feed bobbin for a ring spinning frame. The roving must be a linear textile system with uniform dimensions and mass, and must be suitable for subsequent processing; consequently the protective twist applied to the roving gives it only a low degree of cohesion. When the roving is wound on to the bobbin, a constant tensile force must be maintained on the roving between the point of departure from the slubbing frame and the roving bobbin, without exceeding the rather low tensile strength of the roving imparted by its small twist.

Prior art devices for producing roving include what is known as a flyer spinning frame, which comprises a sliver drafting machine, a flyer, and a spindle. From the drafting machine, the sliver is guided across the guide opening in the fixed plate on the flyer arm, which is fitted rotatably about its vertical axis in the vertically fixed part of the frame. At the lower end of the flyer arm, which retains the sliver, there is a presser finger on to which the sliver is transferred from the inner arm of the flyer, the presser finger being provided with a guide plate adjacent to the surface of the bobbin onto which the roving is wound. The roving is formed by the rotation of the bobbin and the rotation of the flyer. While the roving is being wound onto the bobbin, it passes through a number of turns (wraps) on the surface of the presser finger, which promotes the application of the protective twist, described below, to the roving. The bobbin is positioned with its longitudinal axis vertical, and is fitted on a vertically located rotating spindle which is fitted rotatably on the vertically movable part of the frame. The sliver leaving the drafting frame is twisted into roving by the rotary movement of the bobbin and flyer, and is then wound on to a bobbin in such a way that the flyer with the presser finger rotates around the bobbin, which simultaneously moves vertically to guide the wound roving along the length of the bobbin, the roving receiving a limited twist as a result of the rotary movement of the flyer before the roving is laid on the bobbin. The roving wound in this way has a fibre structure such that each fibre in the cross section of the roving is substantially twisted in the direction of the protective twist of the roving.

A drawback of this equipment is the relatively low roving production rate, averaging 20 to 40 meters per minute, due to the difficulties of the twisting process which make it impossible to achieve high speeds, and therefore high productivity, in the production of roving. A further drawback of this solution is the structure of the resulting roving, in which each fibre in the cross section of the roving is substantially twisted in the direction of the protective twist of the roving, which limits to some extent the attainable quality of yarns subsequently formed from this roving. A further drawback of this arrangement is the relatively high price of such equipment.

There is also a known device disclosed in EP 2 112 258 (US2009/0289141), in which the resulting roving contains fibres lying parallel virtually throughout its cross section and only a few fibres on the outer surface of the roving are wound around the body of the roving, causing the roving to remain sufficiently cohesive and substantially compensating for the protective twist of the roving created on flyer spinning frames. This effect is achieved by using a pneumatic device placed on the sliver drafting frame. The pneumatic device comprises a spinning chamber in which individual fibres of the sliver are wound around the core fibres. After the pneumatic device, there is a roving winder comprising a rotary spindle for a bobbin which is coupled to a driven pair of delivery rollers which are arranged immediately before the roving bobbin, and which have a nip line through which the wound roving passes. In order to guide the roving along the length of the roving bobbin, the delivery rollers can be arranged movably along the roving bobbin or the delivery rollers can be coupled to a guide element which helps to guide the roving along the roving bobbin and along the nip line of the delivery rollers. Similarly, the roving bobbin can be axially movable while the delivery roller remains in place. Since guiding by means of the delivery rollers which are movable along the roving bobbin or by means of a roving bobbin which is movable relative to stationary delivery rollers requires the handling of a relatively large mass, it is preferable to guide the roving by means of a roving guide element when this solution is used. The advantage of this device is that it enables the roving to be wound at high speeds of up to 600 meters per minute, but this solution has the drawback of being technically demanding and occupying a large amount of space, while, owing to the presence of an unguided section between the bobbin and the delivery cylinders, the tension on the roving may be unstable and the roving may break. Another disadvantage is the price.

SUMMARY OF THE INVENTION

An object of the present invention is to enable high roving winding speeds to be achieved while the roving is guided in such a way as to anticipate an unstable tension on the roving which might cause the roving to break during winding, and high quality winding is obtained while the production, operating and energy requirements of the winder are decreased. Additional objects and advantages of the invention will be set forth in part in the following description, or may be obvious from the description, or may be learned through practice of the invention.

BRIEF DESCRIPTION OF THE INVENTION

The objects of the invention are achieved by means of a presser finger for a roving winder, having the essential feature that the carrying arm with the guide plate is alternatingly movable along the longitudinal axis of the bobbin.

The advantage of this invention is that higher winding speeds than existing standard speeds in winders can be achieved by means of a presser finger while obtaining high quality winding and prevent the roving from breaking as a result of the tension on the roving. The winding speed achieved according to the invention is of the order of hundreds of meters per minute, typically in the range from 100 to 400 meters per minute, with the potential to raise the winding speed above 400 meters per minute. The invention also makes it possible to reduce the mechanical complexity of the winder and decrease overall energy consumption for roving winding. These advantages also enable the variety of types of roving production to be increased considerably. This enables the roving to be wound onto bobbins which are processed by high-speed systems such as air-jet spinning machines.

The advantageous embodiments described herein can extend the features of the presser finger according to the invention, particularly in terms of the spatial arrangement of the winder with the bobbin positioned either vertically or horizontally, and can also extend the possibilities offered by the invention in terms of the control of the speed of movement of the wound roving and the tension in the wound roving.

BRIEF DESCRIPTION OF THE DRAWINGS

Exemplary embodiments of the presser finger according to the invention will now be described with the aid of FIGS. 1 to 3.

DETAILED DESCRIPTION

Figure 1:
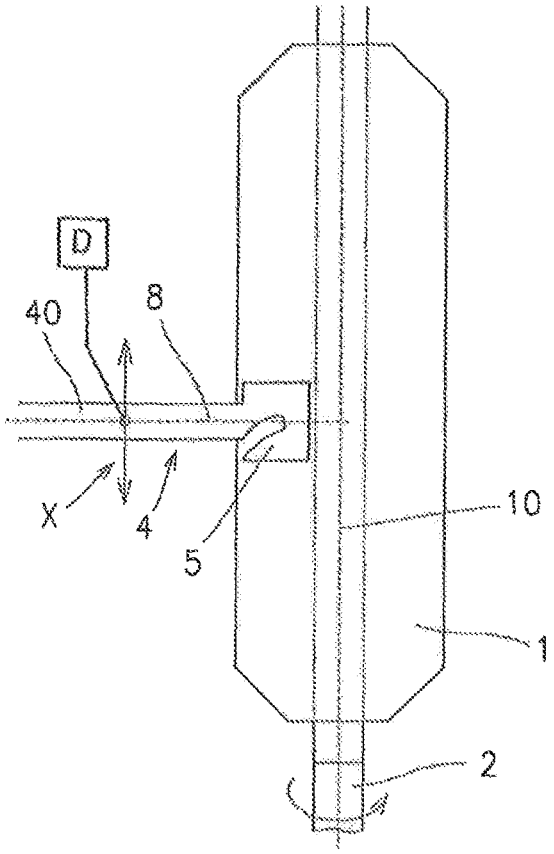
FIG. 1 shows the arrangement of a presser finger and a bobbin.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The presser finger of a roving winder is a component of a roving winder for winding a roving onto a revolving bobbin. The roving being wound is guided with the aid of the presser finger along the height and/or width of the bobbin and is wound progressively in individual layers, thus progressively forming a wound bobbin for further processing.

The presser finger comprises a carrying arm provided with a roving guide plate, the carrying arm with the guide plate being movable along the longitudinal axis of the bobbin; in other words, the roving being wound is guided along the length and/or width of the bobbin by the movement of the presser finger along the rotating bobbin. The bobbin can be positioned either vertically or horizontally or in practically any other orientation. Clearly, the preferred orientation of the longitudinal axis of the bobbin is vertical or horizontal.

The presser finger is provided with at least one roving guide element which is rotatable about the longitudinal axis of the carrying arm. The longitudinal axis of the carrying arm is perpendicular to the direction of movement of the presser finger along the bobbin, the rotatable roving guide element of the presser finger made in the form of a disc or as an additional part of the presser finger, for example an outer shell fitted rotatably on the carrying arm, or the like. Essentially, it is possible for only one of the parts of the presser finger to be rotatable, or for two or three or more of the parts to be rotatable simultaneously. For example, only the carrying arm is rotatable, while the guide plate is fixed, or the carrying arm is rotatable and the guide plate and outer shell are fixed, or the carrying arm and guide plate are rotatable and the outer shell is fixed, or the outer shell is rotatable and the carrying arm and guide plate are fixed, and so on. For the purpose of this rotation, the rotatable part is connected to a suitable drive means and the drive means is provided with a suitable controller.

While it is being wound on to the bobbin, the roving passes through a braking means located either on the carrying arm or on the roving guide element. The roving braking means can be used, in particular, to control the tension in the roving wound on to the bobbin. This control can be of the stepped or continuous type and can be applied, in view of the arrangement of the presser finger, during the winding of the roving thus enabling the possibilities of the winder to be extended further.

The roving braking means is made, for example, in the form of a surface of the carrying arm and/or a guide plate and/or an additional part of the presser finger (an outer shell and/or disc); alternatively, the braking means can be made in the form of a braking element fitted to any of the parts of the presser finger, in other words on the carrying arm, on the outer shell or disc, or on the guide plate, or elsewhere. The braking element can be fixed or rotatable with the rotatable part of the presser finger, or can be independently rotatable about the longitudinal axis of the carrying arm. If the braking means is fitted to a rotatable part of the presser finger, it is theoretically unnecessary for it to be independently rotatable, but it is possible for the braking element to be independently rotatable on another rotatable part of the presser finger. The braking element is substantially made in the form of a radial projection on any of the parts of the presser finger, for example a transverse pin, or in the form of a shaped slot or recess in the disc of the guide element or roving guide means, or similar.

In principle, different combinations of the individual elements of the presser finger can be used in order to achieve the objects of the invention.

Referring to the figures, clearly, the aforesaid presser finger is a component of a winder for winding a roving 9 on to a rotating bobbin 1. The winder winds the roving 9 on to a rotating bobbin 1. The roving 9 is guided by the presser finger 4 with a roving guide element and guide plate 5, while the presser finger 4 moves in an alternating way along the longitudinal axis 10 of the rotating bobbin 1. The presser finger 4 also moves transversely with respect to the longitudinal axis 10 of the rotating bobbin 1, as the diameter of the rotating bobbin 1 increases because of the roving 9 wound on it. The roving 9 is wound at least once around the roving guide element, and the roving 9 is then positioned on the rotating bobbin 1 by the guide plate 5. The guide plate 5 contacts or almost contacts the rotating bobbin 1 and the roving 9 is wound around the roving guide element by the rotation of the roving guide element of the presser finger 4 and/or by the rotation of the carrying arm 40 of the presser finger 4 and/or by the rotation of the guide plate 5 of the presser finger 4. The rotation of the roving guide element of the presser finger 4 and/or the rotation of the carrying arm 40 of the presser finger 4 and/or the rotation of the guide plate 5 of the presser finger 4 is provided by the drive means in the course of winding. For the practical control of the tension in the roving, the rotation of the roving guide element of the presser finger 4 and/or the rotation of the carrying arm 40 of the presser finger 4 and/or the rotation of the guide plate 5 of the presser finger 4 is provided by the drive means in the course of winding, according to the tension on the roving, and is used to set the desired tension on the roving.

The presser finger 4 with the guide plate 5 for the roving 9 is alternatingly movable in the direction X of the longitudinal axis 10 of the bobbin 1, in order to guide the roving 9 along the height and/or width of the bobbin 1 which is rotatable about its longitudinal axis 10. The guide plate 5 for the roving 9 is fitted on the carrying arm 40 of the presser finger 4, while the presser finger 4 is connected to the drive (not shown) for alternating movement in the direction X of the longitudinal axis 10 of the bobbin 1, and the drive is connected to a control means (not shown).

In particular, the presser finger 4 is provided with a roving braking means, which in the illustrated exemplary embodiments is based on the principle of a change in the degree of winding, in other words the number of turns or the angular extent of the winding of the roving 9 around the appropriate part of the presser finger 4, in order to improve the controllability of the process of winding the roving 9 on to the bobbin 1. The change in the degree of winding can be either smooth or stepped, and is applied in the course of winding.

Figure 2:
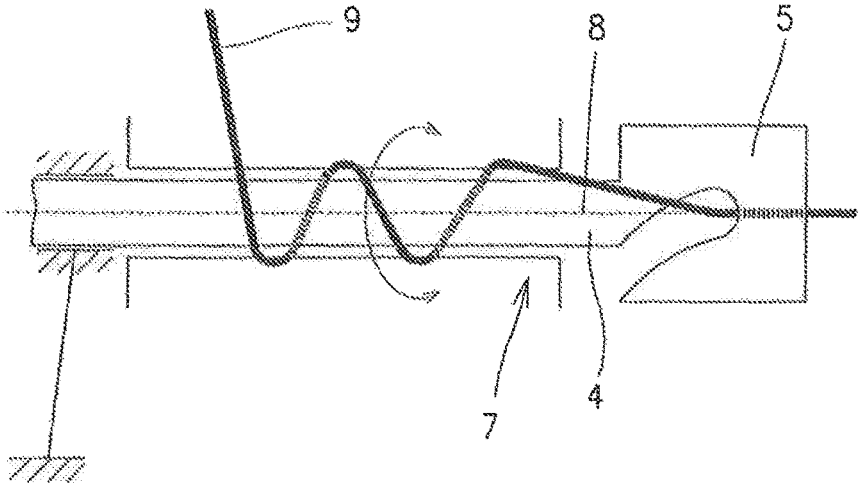
FIG. 2 shows an exemplary embodiment of the presser finger with a roving braking means.

In the embodiment shown in FIG. 2, the presser finger 4 is provided with an outer shell 7, the presser finger 4 being non-rotatable about its longitudinal axis 8, which is perpendicular to the direction X of the longitudinal axis 10 of the bobbin 1, while the outer shell 7 is rotatable about the axis 8. The roving 9 is guided onto the outer surface of the outer shell 7, is wound around this surface and then enters the roving guide plate 5. The rotation of the outer shell 7 about the axis 8 causes a change in the degree of winding (the number of turns) of the roving 9 around the outer shell 7, thus also changing the size of the braking part formed on the roving 9.

Figure 2A:
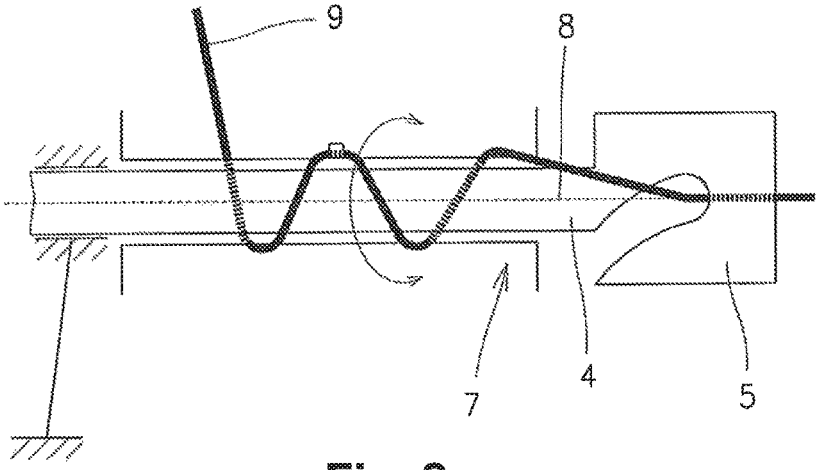
FIGS. 2*a* to 2*d* show variant embodiments of the presser finger with roving braking means.

As shown in FIG. 2*a*, a deflecting guide 11 for the roving 9 is formed on the outer periphery of the outer shell 7. The deflecting guide 11 is made in the form of a radially orientated pin in the illustrated exemplary embodiment. During the winding, the roving 9 is guided along the first part of the outer shell 7 and wound in one direction, for example in a clockwise direction, after which the roving 9 passes through the deflecting guide 11 to the second part of the outer shell 7 and the roving 9 is wound around this second part in the opposite direction, for example in an anticlockwise direction. The roving 9 then travels on to the guide plate 5 and to the bobbin 1.

Figure 2B:
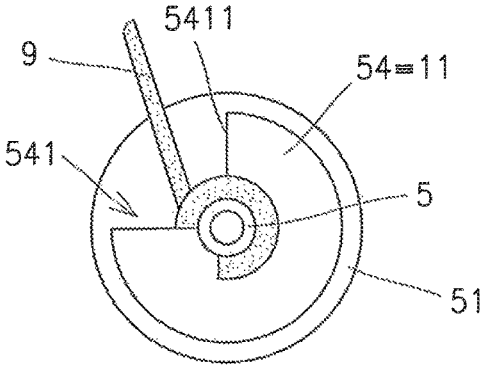

In the exemplary embodiment shown in FIG. 2*b*, the deflecting guide 11 for the roving 9 is made in the form of a disc 54 which is coaxial with the outer shell 7, and which is fixed to the outer shell 7 in the central part of the length of the outer shell 7, a radial recess 541 being created in the disc 54 in the form of an angled cut-out at a suitable angle, for example 90°, and the roving 9 is wound around the working wall 5411 of the radial recess, in other words with a change in the direction of winding of the roving 9 around the part of the outer surface of the outer shell 7 between the part before the disc 54 and the part after the disc 54.

Figure 2C:
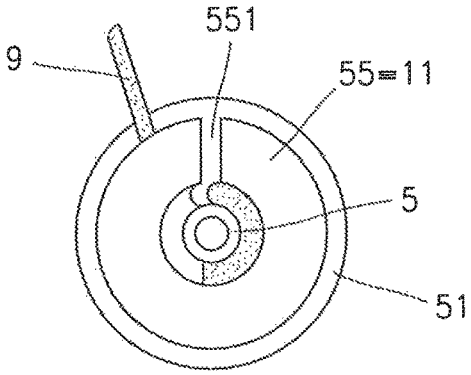

In the embodiment shown in FIG. 2*c*, the deflecting guide 11 for the roving 9 is made in the form of a disc 55 which is coaxial with the outer shell 7, and which is fixed to the outer shell 7 in the central part of the length of the outer shell 7, a radial recess 551 being created in the disc 55 with an enlarged portion in the proximity of the braking surface of the outer shell 7. This embodiment holds the roving 9 correctly in the radial recess 551 when the outer shell 7 rotates about its longitudinal axis. With the aid of the radial recess 551, the roving 9 is wound onto the braking surface of the outer shell 7 with a change in the direction of winding of the roving 9 around the outer surface of the outer shell 7 between the parts before the disc 55 and after the disc 55.

Figure 2D:
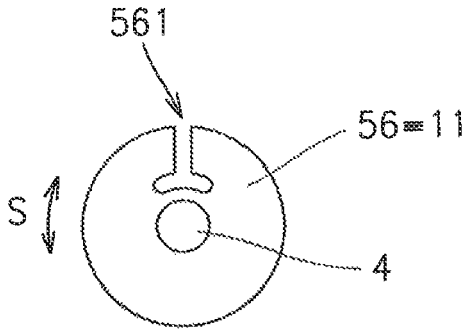

In the embodiment shown in FIG. 2*d*, the deflecting guide 11 for the roving 9 is made in the form of a disc 56 which is coaxial with the outer shell 7, and which is fixed to the outer shell 7 in the first part of the length of the outer shell 7, a radial recess 561 being created in the disc 56 with an enlarged portion in the proximity of the braking surface of the outer shell 7. If the roving 9 passes through the radial recess 561, the rotation of the outer shell 7 about its longitudinal axis causes an increase or decrease in the number of turns of the roving 9 around the braking surface of the outer shell 7 arranged in the direction of movement of the roving after the disc 56, leading to a change in the degree of winding of the roving 9 around the outer surface of the outer shell 7, and thus changing the braking force acting on the roving 9. In an exemplary embodiment which is not shown, the disc 56 and the radial recess 561 are provided with a radially orientated pin, in other words one which is transverse with respect to the direction of movement of the roving 9.

Figure 3:
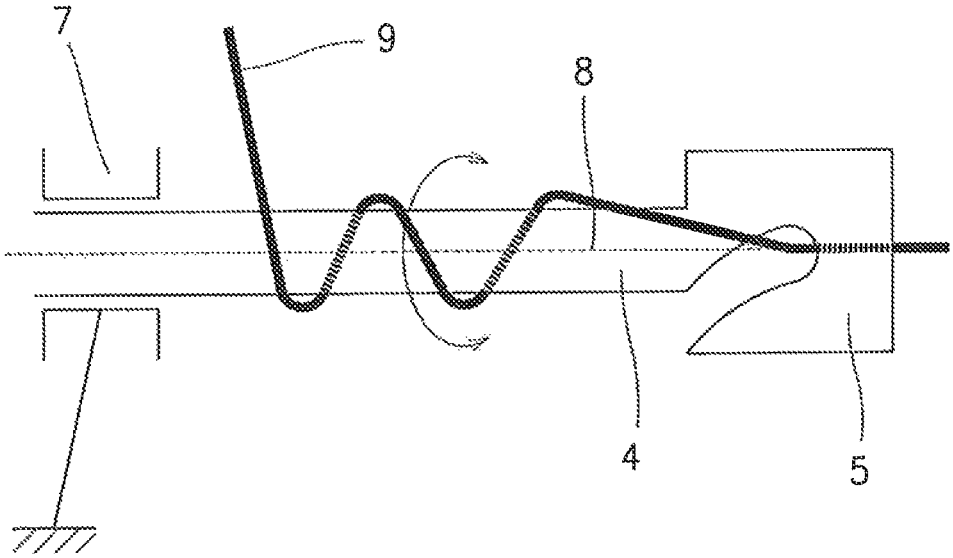
FIG. 3 shows another embodiment of the presser finger with a roving braking means.

In the embodiment shown in FIG. 3, the carrying arm 40 and the guide plate 5 are rotatable together about the axis 8 and the outer shell 7 is not rotatable about the axis 8. The roving 9 is either guided directly to the guide plate 5 for the roving 9 and then on to the bobbin 1, or is first guided on to the outer surface of the carrying arm 40 and wound around it and then guided to the guide plate 5 for the roving 9 and subsequently to the bobbin 1. The rotation of the carrying arm 40 about the axis 8 causes a change in the degree of winding (the number of turns) of the roving 9 around the guide plate 5 or the carrying arm 40, thus also changing the size of the braking part formed on the roving 9. In an exemplary embodiment which is not shown, the deflecting guide 11 is positioned on the outer periphery of the carrying arm 40.

Similarly, in another exemplary embodiment which is not shown, the arrangement is such that only the guide plate 5 rotates about the axis 8, while all the other components are non-rotatable about the axis 8. In this embodiment also, the roving 9 is guided either directly to the guide plate 5 and then on to the bobbin 1, or is first guided on to the outer surface of the carrying arm 40 and wound around it and then guided to the guide plate 5, the rotation of the guide plate 5 about the axis 8 changing the degree of winding (the number of turns) of the roving 9 around the guide plate 5 or the carrying arm 40, thus also changing the size of the braking part formed on the roving 9.

In another exemplary embodiment which is not shown, the arrangement is such that only the carrying arm 40 is rotatable about the axis 8 and the deflecting guide 11 is formed on the arm, the guide plate 5 and all other components being non-rotatable about the axis 8.

In another exemplary embodiment which is not shown, the carrying arm 40 is non-rotatable about the axis 8, and the deflecting guide 11 is rotatable about the axis 8, this guide being fitted independently and rotatably on the carrying arm 40 or on the outer shell 7 and being connected independently to a drive means.

In order to provide controlled rotation about the axis 8, the carrying arm 40 and the guide plate 5 or the outer shell 7 or the deflecting guide 11 are coupled to a drive means (not shown) connected to a controller (not shown) which has a means for detecting the speed of movement of the roving 9 and/or a means for detecting the tension in the roving 9, the amount of braking force on the roving 9 being set on the basis of the detected values.

Modifications and variations can be made to the embodiments illustrated or described herein without departing from the scope and spirit of the invention as set forth in the appended claims.

The invention claimed is:

1. A presser finger system for use with a winder for winding a roving onto a rotating bobbin having a longitudinal axis, the presser finger system comprising:

a carrying arm having a longitudinal axis oriented perpendicular to the longitudinal axis of the bobbin;

a roving guide element on the carrying arm formed as an outer shell configured around the carrying arm;

a guide plate configured at an end of the carrying arm;

a drive device configured to move the carrying arm, outer shell, and guide plate in a traversing direction along the longitudinal axis of the bobbin; and wherein at least one of the carrying arm or outer shell is coupled to a drive and rotatable during winding of the roving onto the rotating bobbin about the longitudinal axis of the carrying arm.

2. The presser finger system as in claim 1, further comprising a controller connected with the drive mechanism to control rotation of the carrying arm or outer shell.

3. The presser finger system as in claim 1, further comprising a roving braking device configured on one of the carrying arm or outer shell.

4. The presser finger system as in claim 3, wherein the roving braking device comprises a deflector connected to the carrying arm or outer shell.

5. The presser finger system as in claim 4, wherein the deflector comprises a radial disc configured on the carrying arm or outer shell, the radial disc having a recess or cut-out through which the roving passes.

6. A winder for winding a roving onto a rotating bobbin, comprising:

a bobbin rotatably driven relative to a longitudinal axis of the bobbin;

a presser finger system, further comprising:

a carrying arm having a longitudinal axis oriented perpendicular to the longitudinal axis of the bobbin;

a roving guide element on the carrying arm formed as an outer shell configured around the carrying arm;

a guide plate configured at an end of the carrying arm;

a drive device configured to move the carrying arm, outer shell, and guide plate in a traversing direction along the longitudinal axis of the bobbin; and wherein at least one of the carrying arm or outer shell is coupled to a drive and rotatably driven during winding of the roving onto the rotating bobbin about the longitudinal axis of the carrying arm.

7. A method for winding a roving onto a rotating bobbin in a winder, comprising:

guiding the roving onto the bobbin with a presser finger having a carrying arm with a roving guide element formed as an outer shell configured around the carrying arm and a guide plate configured at an end of the carrying arm for depositing the roving onto the bobbin, the bobbin rotatably driven relative to a longitudinal axis of the bobbin;

driving the presser finger in a traversing direction along the longitudinal axis of the bobbin while guiding the roving onto the bobbin;

maintaining a constant tension on the roving by winding the roving at least once around the roving guide element and rotating at least one of the carrying arm, or the outer shell during the winding process.

8. The method as in claim 7, further comprising controlling the degree of winding of the roving around the roving guide element by controlling a drive device connected to the rotatable one of the carrying arm, or the outer shell.

9. The method as in claim 8, further comprising controlling the degree of winding of the roving around the outer shell as a function of a desired degree of tension in the roving being wound onto the bobbin.

* * * * *